US006905806B2

(12) United States Patent
Naito et al.

(10) Patent No.: US 6,905,806 B2
(45) Date of Patent: Jun. 14, 2005

(54) DRY TWO-COMPONENT TYPE DEVELOPER FOR ELECTROPHOTOGRAPHY

(75) Inventors: Takeshi Naito, Kashiwa (JP); Hiromichi Kobayashi, Kashiwa (JP); Tsuyoshi Itagoshi, Kashiwa (JP); Yuji Sato, Kashiwa (JP)

(73) Assignee: Powdertech Co., Ltd., Chiba (JP)

( * ) Notice: Subject to any disclaimer, the term of this patent is extended or adjusted under 35 U.S.C. 154(b) by 86 days.

(21) Appl. No.: 10/653,598

(22) Filed: Sep. 2, 2003

(65) Prior Publication Data

US 2004/0043320 A1 Mar. 4, 2004

(30) Foreign Application Priority Data

Sep. 2, 2002 (JP) ..... 2002-256783

(51) Int. Cl.[7] ..... G03G 9/00

(52) U.S. Cl. ..... 430/111.33; 430/111.31; 430/111.4

(58) Field of Search ..... 430/111.33, 111.31, 430/111.4

(56) References Cited

U.S. PATENT DOCUMENTS 5,558,967 A * 9/1996 Nagatsuka et al. ..... 430/108.6

FOREIGN PATENT DOCUMENTS

| | | | |
|---|---|---|---|
| JP | 08-030022 | A | 2/1996 |
| JP | 08-062899 | A | 3/1996 |
| JP | 11-295934 | A | 10/1999 |
| JP | 2000-010341 | A | 1/2000 |

* cited by examiner

*Primary Examiner*—Mark A. Chapman
(74) *Attorney, Agent, or Firm*—The Webb Law Firm, P.C.

(57) ABSTRACT

A dry two-component developer for electrophotography comprising a carrier particle and a toner particle, wherein a toner water adsorption ratio (T) obtained by a following equation (1) for the toner particle ranges from 1.0 to 7.0 and a carrier water adsorption ratio (C) obtained by a following equation (2) is 20.0 or less, and a water adsorption ratio (T/C) expressed in a following equation (3) representing a relationship between the toner water adsorption ratio (T) and the carrier water adsorption ratio (C) is 5.0 or less;

a toner water adsorption ratio ($T$)=a water adsorption amount ($T_H$) of the toner particle/an $N_2$ adsorption amount ($T_N$) of the toner particle (1), a carrier water adsorption ratio ($C$)=a water adsorption amount ($C_H$) of the carrier particle/an N2 adsorption amount ($C_N$) of the carrier particle (2), and a water adsorption ratio ($T/C$)=a toner water adsorption ratio ($T$)/a carrier water adsorption ratio ($C$) (3).

7 Claims, No Drawings

DRY TWO-COMPONENT TYPE DEVELOPER FOR ELECTROPHOTOGRAPHY

FIELD OF THE INVENTION

The present invention relates to a dry two-component type developer for electrophotography in which a developing characteristic is less varied depending on a use environment.

BACKGROUND OF THE INVENTION

A dry developing method utilizing an electrophotographic system serves to directly stick toner powder to an electrostatic latent image on a photosensitive acceptor, thereby forming an image. A two-component type developer and a one-component type developer comprising only toner particles are used for the developers. The two-component type developer easily maintains the toner particles in a stable charging state. For this reason, recently, a reliable two-component type developer has often been used. The two-component type developer contains toner particles and carrier particles. The carrier particles serve to give a desirable electric charge to the toner particles and to deliver the charged toner particles to a photosensitive acceptor. Moreover, the toner particles contain a colorant and can be selectively stuck to an electrostatic latent image formed on the photosensitive acceptor to form an image, and can fix the image thus formed to a recording medium such as a paper.

Conventionally, a dry developing method utilizing an electrophotographic system has mostly been utilized for monochrome copying and printing. In recent years, the dry developing method has also been utilized in color copying and printing. Furthermore, a developing apparatus has been diversified. For this reason, the design of a developer has been required that is suitable for various processes. In particular, a toner particle to be used for the color copying and printing has a smaller particle size than that of a toner particle to be used in the conventional monochrome copying and printing in order to meet a very stringent requirement for an enhancement in picture quality in a market. In order to exhibit a charging property required for the toner particle thus made fine, the surface of the toner particle is modified. There occurs a problem in that a characteristic such as a water absorptivity is remarkably changed depending on the surface modification or the like.

On the other hand, it is necessary to manufacture a toner particle having a small particle size and a sharp particle size distribution with a high yield. Therefore, a toner particle manufactured by a polymerizing method has been used more often than a toner particle manufactured by a grinding method according to the conventional art.

Referring to a polymerized toner, a resin particle obtained by emulsion polymerization, suspension polymerization or the like is used as a toner particle. In such a polymerized toner, an emulsifying agent, a dispersing agent or the like used in the manufacture of the resin particle remains on the surface of the resin particle. A characteristic such as a water absorptivity of the toner particle is changed depending on such a component stuck to the surface.

When the water absorptivity of the toner particle is thus changed, the charging amount of a developer remarkably fluctuates depending on a use environment so that a dependency on an environment is increased. On a high temperature and high humidity condition (hereinafter referred to as an "HH condition") (for example, 35° C. and 80% RH), consequently, the charging amount of a developer is reduced so that an image defect such as a fog or toner scattering is apt to occur. On a low temperature and low humidity condition (hereinafter referred to as an "LL condition") (for example, 10° C. and 20% RH), furthermore, the storage of the electric charge of a developer, that is, a so-called charge-up phenomenon easily occurs so that an image defect such as an insufficient image density is apt to be caused. On the other hand, Japanese Laid-Open Patent Publication No. 2000-10341 has proposed to employ a method of carrying out filter-off by filter pressing when filtering a colored resin particle from a liquid medium in respect to an uniform wash of the surface of a toner particle in order to relieve a change in a characteristic caused by a fluctuation in the use environment of the polymerized toner. In this method, however, a reduction in the charging amount on the HH condition cannot be suppressed. In recent years, furthermore, a demand for more stabilizing the characteristic of a developer against a change in an environment has been increased. Only an improvement described in the above publication has been insufficient for meeting a recent strict demand.

On the other hand, a carrier particle forming a two-component type developer is roughly divided into an iron powder carrier, a ferrite carrier, a magnetite carrier, a complex carrier and the like. Recently, a resin coated carrier obtained by utilizing the above materials as cores to coat a surface with a resin has widely been used. In such a conventional resin coated carrier, a water absorptivity is changed in the same manner as a toner. For this reason, there occurs a problem in that a charging amount is greatly varied with a change in an environment and the same image defect is caused. In the carrier, particularly, the water absorptivity on the HH condition is increased so that the electric resistance of the carrier is remarkably reduced. Consequently, an electric charge leakage phenomenon is apt to occur. In a developer containing such a carrier particle, there occurs a problem in that an image defect or carrier sticking is caused. On the other hand, Japanese Laid-Open Patent Publication No. Hei 8-62899 has proposed that two kinds of carriers having different environmental variation rates are mixed for use in order to relieve the dependency on an environment of a resin coated carrier. In the method described in the publication, however, it is hard for a developer to meet the demand of the market in a situation in which the dependency on an environment of a toner is deteriorated by a reduction in the particle size of the toner and the advent of the polymerized toner as described above.

Moreover, Japanese Laid-Open Patent Publication No. Hei 11-295934 has described that the rate of metal atoms such as iron or alkaline metal present on the surface of a carrier particle is set to be 7 to 20 number % so that it is possible to obtain an advantage that the storage of an electric charge can be prevented and a stable image can be obtained on the LL condition. However, a developer using such a carrier has a problem in that an electric charge is apt to leak and a desirable charging amount cannot be obtained on the HH condition, resulting in the generation of a fog or the like.

In order to relieve a change in a developer characteristic with a variation in an environment (a dependency on an environment), a developer in which the characteristics of a toner particle and a carrier particle are individually examined has been prepared in consideration of a system using the developer. Even if the respective characteristics are thus examined individually, the characteristic of the developer is not always improved as expected in many cases.

As a result of the investigation of this phenomenon, it has been found that the dependency on an environment of the developer is related to not only the independent characteristic of the toner particle or the carrier particle but also the relationship between the characteristic of the toner particle and that of the carrier particle.

More specifically, the developer is used on the HH condition (for example, 35° C. and 80% RH) and the LL condition (for example, 10° C. and 20% RH) as well as a normal temperature and normal humidity condition (hereinafter referred to as an "NN condition", for example, 23° C. and 60% RH). For this reason, it is preferable that a difference in the characteristic of the developer used on the HH condition and the LL condition should be small.

Conventionally, toner particles having characteristics changed on the HH and LL conditions with difficulty have been prepared and carrier particles having characteristics changed on the HH and LL conditions with difficulty have been prepared, and some of them having excellent characteristics have been combined for use. In some cases in which a carrier particle having a very small variation range in an environment is used, however, the excellent characteristic of the carrier particle cannot be exhibited depending on the toner particle to be used. Furthermore, the characteristic of the whole developer in most cases is more deteriorated than that estimated from the toner particle or the carrier particle, respectively. Taking note of a difference in the amount of a water absorption between a toner particle and a carrier particle to improve the dependency on an environment of a developer, Japanese Laid-Open Patent Publication No. Hei 8-30022 has disclosed the invention of a "two-component type developer for electrostatic development comprising at least a toner and a carrier having $|x-y| \leqq 0.15$ ($\mu g/cm^2$) and $x \leqq 0.5$ ($\mu g/cm^2$), wherein a water absorptivity of the toner is represented by x and a water absorptivity of the carrier is represented by y". However, "the amount of a water adsorption per unit area" described in the publication is calculated by using a false surface area obtained by the assumption that a toner particle and a carrier particle are single dispersed spheres. However, it is apparent that the toner particle and the carrier particle, which are actually used, have a distribution of particle sizes and a specific surface area is varied depending on the state of a surface. In other words, the surface area described in the publication is calculated on the assumption that equal mean particle sizes have the same value even if the distribution of the particle size and the state of the surface are different. In an actual particle, however, the effective surface area of a carrier is substantially changed greatly depending on the irregularities of the surface of a core material, resin coating, baking of resin coating and the like. Accordingly, "the amount of a water adsorption per unit, area" described in the publication is not substantial. For this reason, even if the developer is prepared according to the description of the publication, a change in the charging amount with an environmental variation cannot be reduced.

The present invention overcomes these problems in the prior art by providing a dry two-component type developer for electrophotography in which a dependency on an environment is reduced, the selecting conditions of toner particle and a carrier particle are set, and the dependency on an environment obtained in accordance with the set conditions is small and high image quality having neither a fog nor toner scattering can also be obtained at a high temperature and high humidity.

The present invention also provides a dry two-component type developer for electrophotography which can obtain high picture quality having no carrier sticking by controlling the water absorptivity of a carrier particle.

The present invention further provides a dry two-component type developer for electrophotography which can prevent a defective delivery on a high temperature and high humidity condition and a defective mixture on a low temperature and low humidity condition and can obtain an image of high quality.

The present invention still further provides a dry two-component type developer for electrophotography in which the dependency on an environment of a charging amount is reduced so that a fog and toner scattering are prevented under a high temperature and a high humidity and a sufficient image density can be secured under a low temperature and a low humidity, and furthermore, high picture quality having no carrier sticking can be obtained for a long period of time.

SUMMARY OF THE INVENTION

The present invention provides a dry two-component type developer for electrophotography comprising a carrier particle and a toner particle, wherein a toner water adsorption ratio (T) obtained by a following equation (1) for the toner particle ranges from 1.0 to 7.0 and a carrier water adsorption ratio (C) obtained by a following equation (2) for the carrier particle is 20.0 or less, and a water adsorption ratio (T/C) expressed in a following equation (3) representing a relationship between the toner water adsorption ratio (T) and the carrier water adsorption ratio (C) is 5.0 or less;

a toner water adsorption ratio ($T$)=[a water adsorption amount ($T_H$) of the toner particle/an $N_2$ adsorption amount ($T_N$) of the toner particle](1), a carrier water adsorption ratio ($C$)=[a water adsorption amount ($C_H$) of the carrier particle/an $N_2$ adsorption amount ($C_N$) of the carrier particle](2), and a water adsorption ratio ($T/C$)=[a toner water adsorption ratio ($T$)/a carrier water adsorption ratio ($C$)](3).

In the dry two-component type developer for electrophotography, moreover, it is preferable that the water adsorption ratio (T/C) of the developer should range within 1.0±0.9.

The developer containing a toner particle and a carrier particle which satisfies the conditions defined by the present invention has a small variation range of a charging amount on the HH condition and a charging amount on the LL condition, and a constant image can be formed even if a use environment is changed.

DETAILED DESCRIPTION OF THE INVENTION

A dry two-component type developer for electrophotography according to the present invention will be specifically described.

The dry two-component type developer for electrophotography according to the present invention contains a carrier particle and a toner particle.

Examples of the carrier particle to be used in the present invention include an iron powder carrier, a ferrite carrier, a magnetite carrier, a composite carrier and the like. Examples of the ferrite carrier include ferrite particles expressed in the following formula, that is, Cu—Zn ferrite, Cu—Zn—Mg ferrite, Cu—Mg ferrite, Li—Mg—Ca ferrite, Mn—Mg—Sr ferrite, Mg ferrite, Mn ferrite, Sr ferrite and the like.

$$(MO)_m(Fe_2O_3)_n \quad (A)$$

In the formula (A), m+n=100 mol %, and M represents at least one of metal atoms selected from the group consisting of Li, Ca, Cu, Mn, Zn, Mg, Ti, Sr and Sn. MO represents an oxide of the metal atom or in combination of two or more kinds.

Moreover, the composite carrier is a magnetic powder dispersion carrier constituted by a resin such as an acryl type resin, a polyethylene type resin and a phenol type resin, magnetic powder, a charging control material and the like.

The carrier core material is not particularly restricted but is exemplified as described above. In the present invention, an iron powder carrier can also be used. Although the iron powder has a high saturation magnetization and is excellent in carrier sticking, it has a high carrier chain and is too hard. Therefore, a toner moved to a photosensitive acceptor is scraped off by the chain of the carrier and an electric charge leaks to break an electrostatic latent image on the photosensitive acceptor because the iron powder has a low electric resistance. Consequently, a brush mark is apt to be generated. Moreover, since the resin carrier has a small specific gravity, it has a small stress in a developing machine and is excellent in durability. Because of a small specific gravity, however, a frictional force with the toner is weak, a rise in charging is delayed and a fog and toner scattering are apt to be caused. For the above reasons, it is particularly preferable that the ferrite expressed in the formula (A) should be used.

The carrier core material has a carrier water adsorption ratio varied depending on a substance thereof. For example, it is possible to control the carrier water adsorption ratio by using Li ferrite having a comparatively large water adsorption amount and Cu—Zn ferrite having a comparatively small water adsorption amount.

The mean particle size of the carrier particle used in the present invention ranges from 20 to 100 $\mu$m, and preferably from 20 to 60 $\mu$m. If the mean particle size is less than 20 $\mu$m, the magnetization of the carrier particle per one particle is apt to be deteriorated so that carrier sticking is easily generated. On the other hand, a carrier particle having a mean particle size of more than the above cannot deal with high toner concentration setting for securing a recent developing property of high quality so that a phenomenon such as a fog or toner scattering is apt to be generated.

The carrier core material is usually used as a coated carrier with a surface thereof coated with a resin. Examples of the coating resin to be used include a fluorine type resin, an acryl resin, an epoxy resin, a polyester resin, a fluorine acryl resin, an acryl-styrene resin, a silicone resin or an organic modified silicone resin which is modified with a resin such as an acryl resin, a polyester resin, an epoxy resin, an alkyd resin or an urethane resin.

These coating resins have different water absorptivities due to a chemical structure thereof. More specifically, the water adsorptivity of the coating resin is varied depending on an organic group present in the coating resin. Examples of the organic group having a comparatively high water adsorptivity include a hydroxyl group, a carboxyl group, an amino group, a phenyl group and the like. On the other hand, an organic group having a comparatively low water adsorptivity include an alkyl group such as a methyl group or an ethyl group, a perfluoroalkyl group and the like. Examples of a coating resin in which a water adsorptivity is varied depending on a material of the main skeleton of the resin and a water adsorption amount is apt to be increased in addition to the characteristics of the organic groups include an acryl-styrene type resin, a phenol resin and the like, and examples of a coating resin in which the water adsorption amount is apt to be decreased include a silicone type resin, a fluorine type resin and the like. Moreover, examples of a resin having a middle water adsorption amount include an acryl modified silicone type resin, a resin obtained by mixing a fluorine type resin and an acryl type resin and the like.

In order to secure a stable developer characteristic for a long period of time, furthermore, it is preferable that a resin to be the coating resin should include a component unit expressed in the following formula (I) and/or (II) in which a wear resistance, a peeling resistance and a spent resistance are high.

(I)

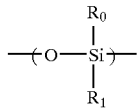

(II)

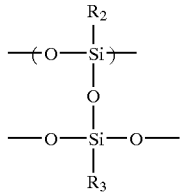

In the formulas (I) and (II), $R_0$, $R_1$, $R_2$ and $R_3$ independently represent a hydrogen atom, a halogen atom, a hydroxyl group, a methoxy group, an alkyl group having a carbon number of 1 to 4 and a phenyl group, respectively.

Examples of a resin having the above chemical structure include the straight silicone resin, the organic modified silicone resin and the like described above. The straight silicone resin is particularly preferable.

In the present invention, furthermore, it is preferable that various additives are used together with the coating resin in order to control charging and a water adsorption. A quaternary ammonium salt type additive, various coupling agents and the like can be used for a charging control agent. For an additive for controlling a water adsorption, the above additive can be used. In particular, an additive having a highly hydrophilic or hydrophobic functional group on a terminal or fine particles subjected to hydrophilic or hydrophobic surface finishing can be used. By using these additives, it is possible to control a water adsorptivity. The types of a charging control agent and a water adsorptive control agent which can be used in the present invention are not restricted. In case of a toner having a negative polarity, a charging control agent for a toner having a positive polarity (a quaternary ammonium salt type or the like) and an amino type silane coupling agent as a coupling agent are particularly preferable. In case of the toner having a positive polarity, moreover, a charging control gent for the toner having a negative polarity (a metal containing monoazo dye or the like) and a fluorine type silane coupling agent as a coupling agent are particularly preferable.

Moreover, it is preferable that a conductive fine particle should be added into the carrier coating agent. The reason is that the absolute resistance of a carrier particle is increased so that a developing capability is deteriorated in some cases in which the amount of a resin to be coated is controlled to be comparatively large. However, the resistance of the conductive fine particle itself is lower than that of a coated resin or a core material. For this reason, in some cases in which an amount of addition is excessively large, a sudden charge leakage is caused. In the present invention, accordingly, the amount of addition of the conductive fine particle is usually 0.25 to 20.0% by weight, preferably 0.5 to 15.0% by weight and particularly preferably 1.0 to 10.0% by weight for the solid content of the coated resin. Examples of the conductive fine particle include conductive carbon, and furthermore, oxides such as titanium oxide and tin oxide.

The coating amount of the resin for the core material in the coating of the resin is usually 0.01 to 10.0 parts by weight, and preferably 0.1 to 5.0 parts by weight for 100 parts by weight of the core material. If the coating amount of the resin is less than 0.01 part by weight, the coated film is apt to be ununiform so that the amount of water adsorption is controlled with difficulty. If the coating amount is more than 10.0 parts by weight, moreover, a lump of carrier particles is apt to be generated during the coating so that a fluidity is deteriorated. Consequently, a delivery failure and a charging defect are caused so that an image defect such as an image density unevenness is apt to be generated.

Such resin layer may be single or may be provided with plural layers. Moreover, components for improving the characteristic of the coating carrier, for example, a charge control agent, a powder characteristic control agent and a coupling agent may be incorporated with the resin layer, and these components may form a separate layer from a resin layer directly coating the carrier.

Moreover, the carrier water adsorptivity can be controlled depending on the degree of the coating of the coating resin into the carrier core material. This utilizes a difference between the amount of water adsorption of the carrier core material and that of the coating resin. When the degree of coating of the coating resin is increased, the influence of the water adsorptivity of the coating resin is increased. Examples of a method of regulating the degree of coating of the coating resin include a method of regulating the surface condition of a carrier core material, a method of regulating an amount of coating of a coating resin, a method of changing coating conditions such as a coating device and the number of coating operations, and the like.

Furthermore, the curing state and the surface condition of the resin can be changed by the execution of a heat treatment or the like after the coating. By the heat treatment, similarly, it is possible to regulate the water adsorptivity by controlling the amount of a hydrophilic group remaining in the outermost layer of the resin.

Referring to the carrier particle to be used in the present invention, a carrier water adsorption ratio (C) expressed in the following equation (2) is calculated.

A carrier water adsorption ratio $(C)$=[a water adsorption amount $(C_H)$ of the carrier particle/an $N_2$ adsorption amount $(C_N)$ of the carrier particle](2)

The carrier water adsorption ratio (C) represents a water adsorptivity per unit surface area of the carrier particle and is obtained by taking a ratio of an $N_2$ adsorption amount $(C_N)$ measured by utilizing the physical adsorption of an $N_2$ molecule to uniformly stick to a carrier surface and a water adsorption amount $(C_H)$ of the carrier particle including a chemical adsorbing portion, that is, the easiness of water absorptivity of the carrier surface in addition to the physical adsorption of an $H_2O$ molecule.

The carrier water adsorption ratio (C) can be calculated by the equation (2) from a water adsorption amount $(C_H)$ of a carrier particle which is measured by adsorbing $H_2O$ as an adsorption gas using an "automatic vapor adsorption amount measuring apparatus Belsorp 18" (manufactured by BEL Japan, Inc.) and an $N_2$ adsorption amount $(C_N)$ of the carrier particle measured by adsorbing $N_2$ as an adsorption gas by using an "automatic specific surface area measuring apparatus GEMINI 2360" (manufactured by SHIMADZU CORPORATION).

In the present invention, a measuring tube to be used for measuring the $N_2$ adsorption amount and the water adsorption amount is obtained by pre-burning at 50° C. for two hours under a reduced pressure before the measurement. Furthermore, the measuring tube is filled with 10 g of the carrier particle when the water adsorption amount is to be measured and with 5 g of the carrier particle when a nitrogen gas adsorption amount is to be measured, and a pretreatment is carried out for two hours at a temperature of 30° C. under a reduced pressure and an $H_2O$ gas and a nitrogen gas are then adsorbed respectively, and their adsorption amounts are thus measured. These adsorption amounts draw an adsorption isotherm and have values calculated by a BET equation.

In an adsorption phenomenon at a comparatively low temperature, the adsorption amount is a function of a pressure. Therefore, the pressure is varied and the adsorption amount is measured at each pressure. A result thus obtained is plotted with axes of abscissa and ordinate indicating the pressure and the adsorption amount, respectively. The adsorption isotherm to be used is thus obtained.

It is preferable that the carrier water adsorption ratio (C) measured for the carrier particle to be used in the present invention should be 20.0 or less. If the carrier water adsorption ratio (C) is more than 20.0, the water adsorption at a high temperature and high humidity becomes excessive and the resistance value of the carrier particle is decreased excessively. Consequently, a developing bias leaks to disturb an electrostatic latent image on a photosensitive acceptor and to generate an image defect, and furthermore, to cause so-called carrier sticking in which the carrier particle is moved onto the photosensitive acceptor.

Examples of a toner particle constituting the developer according to the present invention include a ground toner particle manufactured by a grinding method and a polymerized toner particle manufactured by a polymerizing method. In the present invention, it is possible to use the toner particle obtained by either of the methods.

For example, the ground toner particle can be obtained by fully mixing a binding resin, a charge control agent and a coloring agent by means of a mixing machine such as a HENSCHEL MIXER and subsequently melting and kneading the mixture by means of a twin extruder or the like, and cooling and then grinding and classifying the mixture, and adding an outer additive and mixing them by means of a mixer or the like.

While a binding resin constituting the toner particle is not particularly restricted, it can include polystyrene, chloropolystyrene, a styrene-chlorostyrene copolymer, a styrene-acrylic ester copolymer, a styrene-methacrylic acid copolymer, and furthermore, a rosin modified maleic acid resin, an epoxy resin, a polyester resin, a polyurethane resin and the like. These are used singly or in combination.

Any charge control agent constituting the toner particle can be used. Examples for a positive charging toner include a nigrosine type dye, a quaternary ammonium salt and the like, and furthermore, examples for a negative charging toner include a metal containing monoazo dye and the like.

A conventionally known dye and/or pigment can be used for the coloring agent (colorant).

For example, it is possible to use carbon black, phthalocyanine blue, permanent red, chrome yellow, phthalocyanine green and the like. In addition, it is possible to add an outer additive such as silica powder, titania or the like depending on a toner particle in order to enhance the fluidity and an aggregation resistance of a toner.

A polymerized toner particle is manufactured by a well-known method such as a suspension polymerizing method or an emulsion polymerizing method. Such a polymerized toner particle is obtained, for example, by mixing and stirring a coloring dispersion solution of a coloring agent in the water using a surface active agent, a polymerizable monomer, a surface active agent and a polymerization initiator in a water medium, and emulsifying and dispersing the polymerizable monomer in the water medium, and stirring, mixing and polymerizing the polymerizable monomer, and then adding a salt-out agent to salt out a polymer particle. The particle obtained by the salting-out is filtered, washed and dried so that the polymerized toner particle can be obtained. Thereafter, the outer additive is added to the dried toner particle if necessary.

In the manufacture of the polymerized toner particle, furthermore, it is possible to blend a fixing improvement agent and a charging control agent in addition to a polymerizable monomer, a surface active agent, a polymerization initiator and a coloring agent, and various characteristics of the polymerized toner particle thus obtained can be controlled and improved. Moreover, it is possible to use a chain-transfer agent in order to improve the dispersing properties of the polymerizable monomer into a water medium and to regulate the molecular weight of a polymer, which is obtainable.

While the polymerizable monomer to be used in the manufacture of the polymerized toner particle is not particularly restricted, it is possible to use styrene and a derivative thereof, ethylenic unsaturated monoolefins such as ethylene and propylene, vinyl halides such as vinyl chloride, vinyl esters such as vinyl acetate, α-methylene fatty monocarboxylates such as methyl acrylate, ethyl acrylate, methyl methacrylate, ethyl methacrylate, 2-ethylhexyl methacrylate, acrylic acid dimethylamino ester and methacrylic acid dimethylamino ester.

A dye and/or a pigment which have/has conventionally been known can be used as a coloring agent (a colorant) for preparing the polymerized toner particle. For example, it is possible to use carbon black, phthalocyanine blue, permanent red, chrome yellow, phthalocyanine green and the like. Moreover, these coloring agents may have surfaces modified by using a silane coupling agent, a titanium coupling agent or the like.

For the surface active agent to be used in the manufacture of the polymerized toner particle, it is possible to use an anionic surface active agent, a cationic surface active agent, an amphoteric surface active agent and a nonionic surface active agent.

Examples of the anionic surface active agent include sodium oleate, salts of fatty acid such as castor oil, alkyl sulfate such as sodium lauryl sulfate and ammonium lauryl sulfate, alkylbenzene sulfonate such as sodium dodecyl benzenesulfonate, alkylnaphthalene sulfonate, alkylphosphate, naphthalene formalin sulfate condensate, polyoxyethylene alkyl sulfate ester and the like. Moreover, examples of the nonionic surface active agent include polyoxyethylene alkylether, polyoxyethylene fatty acid ester, sorbitan fatty acid ester, polyoxyethylene alkylamine, glycerin fatty acid ester, oxyethylene-oxypropylene block polymer and the like. Furthermore, the cationic surface active agent include alkylamine salts such as lauryl amineacetate, quaternary ammonium salts such as lauryltrimethylammonium chloride, stearyltrimethylammonium chloride, and the like. In addition, examples of the amphoteric surface active agent include amino carboxylate, alkyl amino acid and the like.

The surface active agents described above can usually be used in an amount of 0.01 to 10% by weight for a polymerizable monomer. The amount of the surface active agent to be used influences the dispersion stability of the monomer and the dependency on an environment of the polymerized toner particle which is obtained. For this reason, it is preferable that the surface active agent should be used in the amount within the range in which the dispersion stability of the monomer is secured and the dependency on an environment of the polymerized toner particle is excessively influenced with difficulty.

The polymerization initiator is usually used for manufacturing the polymerized toner particle. The polymerization initiator includes a water-soluble polymerization initiator and an oil-soluble polymerization initiator, and both of them can be used in the present invention. Examples of the water-soluble polymerization initiator which can be used in the present invention include persulfates such as potassium persulfate and ammonium persulfate, a water-soluble peroxide compound and the like. Moreover, examples of the oil-soluble polymerization initiator include an azo type compound such as azobisisobutyronitrile, an oil-soluble peroxide compound and the like.

Moreover, examples of the chain-transfer agent to be used in the present invention include mercaptans such as octyl mercaptan, dodecyl mercaptan and tert-dodecyl mercaptan, carbon tetrabromide and the like.

In the case in which the polymerized toner particle to be used in the present invention contains a fixing improvement agent, furthermore, natural wax such as carnauba wax, olefin type wax such as polypropylene and polyethylene can be used for the fixing improvement agent.

In the case in which the polymerized toner particle to be used in the present invention contains a charging control agent, moreover, the charging control agent to be used is not particularly restricted but a nigrosine type dye, a quaternary ammonium salt, an organic metal complex, a metal containing monoazo dye and the like can be used.

For the outer additives to be used for enhancing the fluidity of the polymerized toner particle, furthermore, silica, titanium oxide, barium titanate, fluoric particulates, acrylic particulates and the like can be used singly or in combination.

In addition, examples of the salting-out agent to be used for separating a polymerized particle from a water medium include metal salts such as magnesium sulfate, aluminum sulfate, barium chloride, magnesium chloride, calcium chloride and sodium chloride.

The mean particle size of the toner particle manufactured as above is usually 4.0 to 12.0 μm and preferably 5.0 to 10.0 μm, and the polymerized toner particle has a higher particle uniformity than the ground toner particle. If the size of the toner particle is less than 4.0 μm, a charging capability is deteriorated so that a fog or toner scattering is apt to be caused. If the size of the toner particle is more than 12.0 μm, picture quality is deteriorated.

Referring to the toner particle to be used in the present invention, a water adsorption ratio (T) expressed in the following formula (1) is calculated.

A toner water adsorption ratio ($T$)=[a water adsorption amount ($T_H$) of the toner particle/an $N_2$ adsorption amount ($T_N$) of the toner particle](1)

The toner water adsorption ratio (T) represents a water absorptivity per unit surface area of the toner particle and is obtained by taking a ratio of an $N_2$ adsorption amount ($T_N$) measured by utilizing the physical adsorption of an $N_2$ molecule to uniformly stick to the surface of a toner particle and a water adsorption amount ($T_H$) of the toner particle including a chemical adsorbing portion, that is, the easiness of water absorptivity of the surface of the toner particle in addition to the physical adsorption of an $H_2O$ molecule.

The toner water adsorption ratio (T) can be calculated by the equation (1) from a water adsorption amount ($T_H$) Of a toner particle which is measured by adsorbing $H_2O$ as an adsorption gas by using the automatic vapor adsorption amount measuring apparatus described above and an $N_2$ adsorption amount ($T_N$) of the toner particle measured by adsorbing $N_2$ as an adsorption gas by using the automatic specific surface area measuring apparatus as described above.

In the same manner as the above case, a measuring tube to be used for measuring the $N_2$ adsorption amount and the water adsorption amount is obtained by pre-burning before the measurement. Furthermore, the measuring tube is filled with 1 g of the toner particle when the water adsorption amount is to be measured and with 0.2 g of the toner particle when a nitrogen gas adsorption amount is to be measured, and a pretreatment is carried out on the same conditions as the case of the carrier particle and an $H_2O$ gas and a nitrogen gas are then adsorbed respectively, and their adsorption amounts are thus measured. These adsorption amounts draw an $N_2$ adsorption isotherm and have values calculated by a BET equation.

In an adsorption phenomenon at a comparatively low temperature, the adsorption amount is a function of a pressure. Therefore, the pressure is varied and the adsorption amount is measured at each pressure. A result thus obtained is plotted with axes of abscissa and ordinate indicating the pressure and the adsorption amount, respectively. The adsorption isotherm to be used is thus obtained.

It is preferable that the toner water adsorptivity ratio (T) measured for the toner particle to be used in the present invention should range from 1.0 to 7.0. If the toner water adsorption ratio (T) is less than 1.0, a rise in a charging amount is reduced on the low temperature and low humidity condition so that a mixing defect is apt to be caused. If the toner water adsorption ratio (T) is more than 7.0, moreover, a fluidity is deteriorated and a defective delivery is caused so that an image unevenness is apt to be generated on the high temperature and high humidity condition.

The toner water adsorption ratio (T) can be controlled by the kind of a binder resin to be a base, various additives and a manufacturing method. Examples of the binder resin include a polyester type resin and a styrene-acryl type resin. For both of the resins, the water adsorptivity can be controlled depending on a remaining hydrophilic group. Referring to the additive, it is possible to employ a method using an additive having a functional group having a high hydrophilicity or hydrophobicity, a method of sticking fine particles subjected to a hydrophilic surface finishing or a hydrophobic surface finishing onto the surface of a toner particle, and the like. Referring to the polymerized toner, moreover, the water adsorptivity is varied depending on an emulsifying agent and the type of a surface active agent to be used in manufacture, and a step of washing them.

The developer according to the present invention can be obtained by mixing the toner particle with the carrier particle. In the developer according to the present invention, the toner particle and the carrier particle are mixed together in such a manner that the content (toner concentration) of the toner particle in the developer is usually 2.0 to 15.0% by weight and preferably 3.5 to 12.0% by weight. The dry two-component type developer for electrophotography according to the present invention is obtained by selecting and mixing the toner particle and the carrier particle in such a manner that the water adsorption ratio (T/C) expressed in the following equation (3) calculated for the dry two-component type developer for electrophotography is 5.0 or less.

A water adsorption ratio ($T/C$)=[a toner water adsorption ratio ($T$)/a carrier water adsorption ratio ($C$)](3)

In the dry two-component type developer for electrophotography according to the present invention, furthermore, it is preferable that the toner particle and the carrier particle should be selected in such a manner that the water adsorption ratio (T/C) is to be 1.0±0.9. The reason is as follows. The developer according to the present invention is used in such a manner that the water adsorption ratio (T/C) is 5.0 or less and preferably 1.0±0.9, resulting in a reduction in a variation between the charging amount of the developer on the HH condition and that on the LL condition.

More specifically, the toner particle and the carrier particle are combined for use in such a manner that the water adsorption ratio (T/C) of the developer according to the present invention has a value of 5.0 or less and preferably 1.0±0.9. The setting of the value of the water adsorption ratio (T/C) of the developer into a predetermined range is different from the simple mixture and use of a toner particle having a small amount of water absorptivity and a carrier particle having a small amount of water absorptivity. As is apparent from the present invention, the water adsorptivities of the carrier particle and the toner particle are set into a constant range as described above so that the dependency of the developer on a use environment can be relieved remarkably.

The reason is not definite but can be supposed as follows.

For example, the case in which the water adsorption ratio (T/C) is higher than 5.0 includes that in which both a toner and a carrier have high water absorptivities and that in which both the toner and the carrier have low water absorptivities. In the former case, a bridge of a water molecule (water bridge) is formed on the HH condition and an electric charge is apt to leak through the water bridge and the charging amount is reduced so that an image defect such as a fog or toner scattering is caused. In the latter case, moreover, the electric charge of the developer is excessively stored, that is, a so-called charge-up phenomenon is apt to occur so that an image defect such as an image density insufficiency is generated on the LL condition.

On the other hand, as is employed in the present invention, the water adsorption ratio (T/C) expressed in the equation (3) indicative of the relationship between the toner water adsorption ratio (T) obtained for the toner particle and the carrier water adsorption ratio (C) obtained for the carrier particle is set to be 5.0 or less. Consequently, it is possible to obtain a developer having a low dependency on an environment and a very stable characteristic by using a toner particle having the toner water adsorption ratio (T) ranging from 1.0 to 7.0 and the carrier particle having the carrier water adsorption ratio (T) of 20.0 or less.

Even if a toner particle having a comparatively high toner water adsorption ratio (T) is used, accordingly, it is possible to obtain a developer having a small dependency on an environment by selecting a carrier particle having a high carrier water adsorption ratio (C) in such a manner that the water adsorption ratio (T/C) of the developer is equal to or less than 5.0 and particularly preferably 1.0±0.9.

In order to regulate such a developer, it is possible to combine a carrier coated with an acrylic type resin having a comparatively high water adsorptivity and a coating carrier having a high water adsorptivity, that is, using an additive having a hydrophilic organic group in the case in which a toner having a high water adsorption ratio is used. To the contrary, in the case in which a toner having a low water adsorption ratio is used, it is possible to combine a carrier coated with a silicone type resin having a comparatively low water adsorptivity and a coating carrier having a low water adsorptivity, that is, using an additive having a hydrophobic organic group. The present invention is not restricted thereto.

In the dry two-component type developer for electrophotography according to the present invention, a toner particle and a carrier particle are blended in such a manner that the relationship between a toner water adsorption ratio (T) expressed in a specific equation and a carrier water adsorption ratio (C) expressed in a specific equation has a constant value. Consequently, a charging amount is less varied even if the developer is used on both of the HH and LL conditions. Therefore, an image density is less varied, and furthermore, printing defects such as a fog and toner scattering are hardly generated. In addition, the carrier water adsorption ratio is controlled. Consequently, a bias leakage is lessened on the HH condition and carrier sticking can be prevented. By controlling the toner water adsorption ratio, moreover, it is possible to prevent a delivery defect on the HH condition and a mixing defect on the LL condition, thereby securing an image having a high quality for a long period of time.

EXAMPLES

Examples of the dry two-component type developer for electrophotography according to the present invention will now be described and it will be understood that the present invention is in no way restricted thereto.

Method of Measuring Characteristic of Toner Particle, Carrier Particle and Developer (Method of Measuring Water Adsorption Amount of Toner Particle and Carrier Particle)

The water adsorption amounts of a toner and a carrier were measured by using an "automatic vapor adsorption amount measuring apparatus Belsorp 18" (manufactured by BEL Japan, Inc.) to adsorb $H_2O$ to be an adsorption gas. Before the measurement, a measuring sample tube was pre-burned at 50° C. for two hours under a reduced pressure. Furthermore, the measuring sample tube was filled with 1 g of a sample in case of the toner particle or 10 g of the sample in case of the carrier particle, and a pretreatment was carried out at 30° C. for two hours under a reduced pressure.

(Method of Measuring $N_2$ Adsorption Amount of Toner and Carrier)

The $N_2$ adsorption amounts of a toner and a carrier were measured by using an "automatic specific surface area measuring apparatus GEMINI 2360" (manufactured by SHIMADZU CORPORATION) to adsorb $N_2$ to be an adsorption gas. Before the measurement, a measuring sample tube was pre-burned at 50° C. for two hours under a reduced pressure and was filled with a sample to be measured (0.2 g in case of the toner and 5 g in case of the carrier), and a pretreatment was carried out at 30° C. for two hours under a reduced pressure.

(Method of Measuring Charging Amount Under Each Environmental Condition)

A charging amount under each environmental condition was measured in the following manner.

First of all, a toner and a carrier were individually left for 24 hours under an LL environmental condition (low temperature and low humidity: 10° C. and 20% RH). Under the same environmental condition, then, the toner and the carrier were mixed for 15 minutes by using a "shaking machine YS-LD" (manufactured by YAYOI Co., Ltd.) and charging amounts were measured by using a "blow-off powder charging amount measuring apparatus" (manufactured by Toshiba Chemical Co., Ltd. TB-200) Under an HH environmental condition (high temperature and high humidity: 35° C. and 80% RH), similarly, the charging amounts were measured.

By using the value of the charging amount obtained under each environment condition, a value calculated in the following equation of "environment dependency index" is to represent the dependency on an environment of a charging amount. When the "environmental dependency index" is close to 1.0, the dependency on an environment is decreased, which is preferable. It is preferable that the "environmental dependency index" should be equal to or more than 0.75. If the value is less than 0.75, the dependency on an environmental is increased so that an image defect is generated, resulting in practical troubles.

Environmental dependency index (*HH*/*LL*)=(charging amount under *HH* environment)/(charging amount under *LL* environment)

(Method of Carrying Out Actual Copying Test Under Each Environmental Condition)

An image was formed by using a copying machine put on the market and an evaluation was carried out for an image density, a fog, carrier sticking and the like. Respective measuring conditions and evaluation bases are described as follows. An evaluation environment condition was set to be each of an NN (23° C. and 60% RH) condition, an LL (10° C. and 20% RH) condition and an HH (35° C. and 80% RH) condition.

An actual copying test for first to 50,000th sheets was carried out under the NN condition, and the environmental condition was changed into the LL condition, a solid black image was formed after the end of the copying operations for the first sheet and the 50,000th sheet and an image density was measured by "X-Rite 938" (manufactured by X-Rite Incorporated). It is desirable that the image density should be equal to or more than 1.30.

Referring to a fog, the environmental condition was changed into the HH condition after the end of the copying operations for the first sheet and the 50,000th sheet, and the reflection densities of a white sheet and a white portion of the formed image were measured by using a "coloriometric color difference meter Z-300A" (manufactured by Nippon Denshoku Industries Co., Ltd.) and a difference between their reflection densities was evaluated. It is desirable that the fog should be 1.0 or less.

Referring to carrier sticking, the number of carriers stuck to the white portion under the HH condition was evaluated. The notation of an evaluation is as follows.

◎ . . . excellent
○ . . . good
Δ . . . no practical problem
X . . . practical problem The general evaluation of carrier sticking, an image density (on the first sheet and after the 50,000th sheet) and a fog (on the first sheet and after the 50,000th sheet) was set forth. A criterion is described below.

◎ . . . very excellent for all items
○ . . . good for all items
Δ . . . no practical problem
X . . . practical problem

Carrier Manufacturing Example 1

Raw materials were blended in a proper amount to have 39.7 mol % in term of MnO, 9.9 mol % in term of MgO, 49.6 mol % in term of $Fe_2O_3$ and 0.8 mol % in term of SrO, water was added and they were ground and mixed for 10 hours by means of a wet ball mill, and were then dried and held at 950° C. for four hours, and a slurry ground for 24 hours by means of the wet ball mill was granulated and dried and was held for six hours at a temperature of 1270° C. in an oxygen concentration 2% atmosphere, and was then cracked to regulate a particle size so that a manganese ferrite particle (core material) was obtained.

The manganese ferrite particle has a mean particle size of 35 μm and a magnetization of 70 emu/g was obtained with an applied magnetic field of 3000 oersteds.

In addition, 180 g of a methacrylic acid/methacrylic acid-2-hydroxyethyl/methyl methacrylate copolymer (a weight ratio of 10:25:65) and 20 g of a melamine resin were diluted with 1000 cc of toluene.

10 kg of the ferrite particle and a resin solution prepared as described above were put in a vacuum degassing type kneader and stirred for 30 minutes at a temperature of 120° C., and a pressure was reduced to remove the toluene. Thus, a resin coated film was formed on the surface of the ferrite particle. The resin coating ferrite particle is set to be a carrier 1 (resin coating amount: 2.0% by weight).

As described above, a water adsorption ratio (C) of the carrier having a water adsorption amount regulated was measured. As a result, the carrier 1 had a carrier water adsorption ratio (C) of 6.90.

Carrier Manufacturing Example 2

In the same manner as the carrier 1 according to the carrier manufacturing example 1, a ferrite particle having a mean particle size of 35 μm and a magnetization of 70 emu/g with an applied magnetic field of 3000 oersteds was manufactured.

In addition, 300 g of a methyl methacrylate/methacrylic acid-2-hydroxyethyl copolymer (a weight ratio of 60:40) in term of a solid content and 3 g of a quaternary ammonium salt charging control agent ground to have a size of 1 μm were put in 1000 cc of toluene and were dispersed by using a mill.

10 kg of the ferrite particle and the resin solution prepared as described above were put in a vacuum degassing type kneader and stirred for 30 minutes at a temperature of 120° C., and a pressure was reduced to remove the toluene. Thus, a resin coated film was formed on the surface of the ferrite particle. The resin coated ferrite particle is set to be a carrier 2 (resin coating amount: 3.0% by weight).

As described above, a water adsorption ratio (C) of the carrier having a water adsorption amount regulated was measured. As a result, the carrier 2 had a carrier water adsorption ratio (C) of 15.07.

Carrier Manufacturing Example 3

A ferrite particle having a mean particle size of 60 μm and a magnetization of 65 emu/g with an applied magnetic field of 3000 oersteds was manufactured in the same manner as the carrier 1 according to the carrier manufacturing example 1 except, that a burning condition was set to 1290° C. in an atmosphere having an oxygen concentration of 5%.

10 kg of the ferrite particle and 200 g of a methacrylic acid/methyl methacrylate/methacrylic acid-2-hydroxyethyl/butyl acrylate copolymer (a weight ratio of 35:35:15:15) were mixed for 15 minutes by means of a high-speed stirring type mixing machine. Then, hot water was circulated in the mixing machine and the inside of the mixing machine was heated to 70° C., and at the same time, stirring was carried out for 15 minutes so that a resin coated ferrite particle was manufactured. The resin coated ferrite particle is set to be a carrier 3 (resin coating amount of 2.0% by weight).

As described above, a water adsorption ratio (C) of a carrier having a water adsorption amount regulated was measured. As a result, the carrier 3 had a carrier water adsorption ratio (C) of 7.17.

Carrier Manufacturing Example 4

Raw materials were blended in a proper amount to have 13.3 mol % in term of $Li_2O$, 7.7 mol % in term of MgO, 76.2 mol % in term of $Fe_2O_3$ and 2.8 mol % in term of CaO, water was added and they were ground and mixed for 10 hours by means of a wet ball mill, and were then dried and held at 950° C. for four hours, and a slurry ground for 24 hours by means of the wet ball mill was granulated and dried and was held for six hours at a temperature of 1190° C. in the atmosphere, and was then cracked to regulate a particle size so that a lithium ferrite particle (core material) was obtained.

The lithium ferrite particle has a mean particle size of 60 μm and a magnetization of 60 emu/g was obtained with an applied magnetic field of 3000 oersteds.

In addition, 80 g of a silicone resin having a weight ratio of 2/8 of a silicone resin constituted by the chemical formula (I) ($R_0$=$CH_3$, $R_1$=$CH_3$) described above and a silicone resin constituted by a chemical formula (II) ($R_2$=$CH_3$, $R_3$=$CH_3$) in term of a solid content and 40 g of γ-aminopropyltrimethoxysilane were weighed respectively and dissolved in 1000 cc of toluene.

10 kg of the lithium ferrite and the resin solution were put into an immersion drying type coating apparatus and the toluene was removed to coat the lithium ferrite particle. Then, the lithium ferrite particle was heated at 280° C. for one hour so that the silicone resin was baked onto the surface of the lithium ferrite resin. A resin coated lithium ferrite particle thus obtained is set to be a carrier 4 (resin coating amount of 0.8% by weight).

As described above, a water adsorption ratio (C) of the carrier having a water adsorption amount regulated was measured. As a result, the carrier 4 had a carrier water adsorption ratio (C) of 1.59.

Carrier Manufacturing Example 5

A ferrite particle having a mean particle size of 40 μm and a magnetization of 65 emu/g with an applied magnetic field of 3000 oersteds was prepared in the same manner as the manufacture of the carrier 1 except that a burning condition was set to 1290° C. in an atmosphere having an oxygen concentration of 4%.

In addition, 10 g of an acryl modified silicone resin modified to have a weight ratio of the acryl component as described below to a silicone component of 6/4 in term of a solid content and 5 g of γ-aminopropyltrimethoxysilane were weighed respectively and dissolved in 1000 cc of toluene.

Acryl component: methyl methacrylate/methacrylic acid-2-hydroxyethyl/methyloxypropyltrimethoxysilane=a copolymer having a weight ratio of 60%/28%/12%

Silicone component: In the chemical formula (I) described in the specification, a silicone resin having a weight ratio of 25% for each of ($R_0$=$C_6H_5$, $R_1$=$C_6H_5$), ($R_1$=$C_6H_5$, $R_1$=OH), ($R_0$=$CH_3$, $R_1$=$CH_3$) and ($R_0$=$CH_3$, $R_1$=OH).

10 kg of the ferrite particle and the resin solution were put into an immersion drying type coating apparatus and the toluene was removed to coat the ferrite particle. Then, the ferrite particle was heated at 220° C. for one hour so that the acryl modified silicone resin was baked onto the surface of the ferrite resin. A resin coated ferrite particle thus obtained is set to be a carrier 5 (resin coating amount of 0.1% by weight).

As described above, a water adsorption ratio (C) of the carrier having a water adsorption amount regulated was measured. As a result, the carrier 5 had a carrier water adsorption ratio (C) of 0.82.

Carrier Manufacturing Example 6

Raw materials were blended in a proper amount to have 14.0 mol % in term of CuO, 16.0 mol % in term of ZnO and 70.0 mol % in term of $Fe_2O_3$, water was added and they were ground and mixed for 10 hours by means of a wet ball mill, and were then dried and held at 950° C. for four hours, and a slurry ground for 24 hours by means of the wet ball mill was granulated and dried and was held for six hours at 1150° C. in the atmosphere, and was then cracked to regulate a particle size so that a copper-zinc ferrite particle (core material) was obtained.

The copper-zinc ferrite particle had a mean particle size of 50 μm and a magnetization of 65 emu/g with an applied magnetic field of 3000 oersteds.

In addition, 100 g of a silicone resin having a weight ratio of 2/8 of a silicone resin constituted by the chemical formula (I) ($R_0$=$CH_3$, $R_1$=$CH_3$) described above and a silicone resin constituted by a chemical formula (II) ($R_2$=$CH_3$, $R_3$=$CH_3$) in term of a solid content, 5 g of γ-aminopropyltrimethoxysilane and 5 g of a silica particulate including a primary particle subjected to a hydrophobic treatment with dimethyl silicone oil which has a mean particle size of 17 nm were put in 1000 cc of toluene and were dispersed by using a pearl mill.

10 kg of the copper-zinc ferrite particle was put into a fluid bed coating apparatus and the amount of spray of the resin solution per unit time was regulated in such a manner that a time of 30 minutes is required for coating, and the copper-zinc ferrite particle was coated. Then, the copper-zinc ferrite particle was heated at 260° C. for one hour so that the silicone resin was baked onto the surface of the copper-zinc ferrite resin. A resin coated copper-zinc ferrite particle thus obtained is set to be a carrier 6 (resin coating amount of 1.0% by weight).

As described above, a water adsorption ratio (C) of the carrier having a water adsorption amount regulated was measured. As a result, the carrier 6 had a carrier water adsorption ratio (C) of 0.38.

Carrier Manufacturing Example 7

A ferrite particle having a mean particle size of 45 μm and a magnetization of 70 emu/g with an applied magnetic field of 3000 oersteds was manufactured in the same manner as in the carrier manufacturing example 1 except for granulation conditions, burning conditions and particle size regulating conditions.

In addition, 300 g of a perfluorooctylethylacrylate/methacrylate copolymer (copolymerization ratio=40:60, Mw=50,000) in term of a solid content, 15 g of conductive carbon and 10 g of an untreated hydrophilic silica particulate including a primary particle having a mean particle size of 17 nm were put in 1500 cc of toluene and dispersed by using a pearl mill.

10 kg of the ferrite particle and the resin solution were put in a vacuum degassing type kneader and stirred at 120° C. for 30 minutes, and a pressure was reduced to remove the toluene, and the surface of the ferrite particle was coated with the perfluorooctylethylacrylate/methacrylate copolymer containing carbon black so that a resin coated ferrite particle was manufactured. The resin coated ferrite particle is set to be a carrier 7 (resin coating amount: 3.0% by weight).

As described above, a water adsorption ratio (C) of the carrier having a water adsorption amount regulated was measured. As a result, the carrier 7 had a carrier water adsorption ratio (C) of 29.23.

Carrier Manufacturing Example 8

In the same manner as in the carrier manufacturing example 3, a ferrite particle having a mean particle size of 60 μm and a magnetization of 65 emu/g was manufactured with an applied magnetic field of 3000 oersteds.

In addition, 200 g of a silicone resin having a weight ratio of 2/8 of a silicone resin constituted by the chemical formula (I) ($R_0$=$CH_3$, $R_1$=$CH_3$) described above and a silicone resin constituted by a chemical formula (II) ($R_2$=$CH_3$, $R_3$=$CH_3$) in term of a solid content, 100 g of γ-aminopropyltrimethoxysilane, 10 g of conductive carbon in term of a solid content and 6 g of a silica particulate including a primary particle subjected to a hydrophobic treatment with dimethyl silicone oil which has a mean particle size of 17 nm were put in 1000 cc of toluene and were dispersed by using a pearl mill.

10 kg of the ferrite particle was put into a fluid bed coating apparatus and the amount of spray of the resin solution per unit time was regulated in such a manner that a time of 60 minutes is required for coating, and the ferrite particle was coated. Then, the coated ferrite particle was heated at 220° C. for one hour so that the silicone resin was baked onto the surface of the coated ferrite resin. A resin coated manganese ferrite particle thus obtained is set to be a carrier 8 (a resin coating amount of 2.0% by weight).

As described above, a water adsorption ratio (C) of the carrier having a water adsorption amount regulated was measured. As a result, the carrier 8 had a carrier water adsorption ratio (C) of 1.05.

Toner Manufacturing Example 1

For a resin particulate dispersion solution, 350 g of styrene, 100 g of n-butyl acrylate, 7 g of acrylic acid, 5 g of dodecyl mercaptan and 5 g of carbon tetrabromide were mixed and dissolved to prepare a raw material solution, 4 g of a nonionic surface active agent and 12 g of anionic surface active agent were dissolved in 550 g of ion-exchange water, and the raw material solution was added to the solution and was dispersed and emulsified in a flask. A solution having 4 g of ammonium persulfate dissolved in 50 g of the ion-exchange water was put in the emulsifying solution and nitrogen substitution was carried out, and heating was performed so that a resin particulate dispersion solution was obtained.

For a coloring agent dispersion solution, 100 g of carbon black and 8 g of a nonionic surface active agent were dispersed into 200 g of ion-exchange water by using a homogenizer so that a coloring agent dispersion solution was obtained.

For a mold-releasing agent dispersion solution, 100 g of paraffin wax, 8 g of a cationic surface active agent and 200 g of ion-exchange water were heated and dispersed by using the homogenizer and a dispersion treatment was then carried out by using a pressure discharge type homogenizer. Consequently, the mold-releasing agent dispersion solution was obtained.

The resin particulate dispersion solution, the coloring agent dispersion solution, the mold-releasing agent dispersion solution and the cationic surface active agent were taken in amounts of 200 g, 20 g, 50 g and 5 g respectively, and they were mixed and dispersed by using the homogenizer in a round stainless flask and were then heated and cooled so that an aggregated particle dispersion solution was obtained.

5 g of the anionic surface active agent was added to the sticking particle dispersion solution and was heated under stirring. Then, cooling was carried out to filter a reaction product and was sufficiently washed with the ion-exchange water, and was then dried so that powder having a mean particle size of 6 μm was obtained. 1 g of a hydrophobic silica particulate and 1 g of a hydrophobic titanium oxide particulate were mixed into 100 g of powder by means of a HENSCHEL MIXER so that a toner particle was obtained. The toner particle is set to be a toner 1.

Referring to the toner 1, a toner water adsorption ratio (T) was measured. As a result, the toner water adsorption ratio (T) of the toner 1 was 2.84.

Toner Manufacturing Example 2

81 g of a polyester resin, 7 g of a carnauba wax, 6 g of C.I. pigment red and 6 g of a silica particulate were kneaded by a kneading machine and cooled, and were then ground finely by means of a jet mill so that powder having a mean particle size of 6.5 μm was obtained by a classifier. 1 g of a hydrophobic silica particulate and 1 g of a hydrophobic titanium oxide particulate were mixed into 100 g of the powder by means of a HENSCHEL MIXER so that a ground toner was obtained. The toner particle is set to be a toner 2.

Referring to the toner 2, a toner water adsorption ratio (T) was measured. As a result, the toner water adsorption ratio (T) of the toner 2 was 2.17.

Toner Manufacturing Example 3

15 g of carbon black as a coloring agent, 7 g of sodium dodecyl sulfate and 150 g of ion-exchange water were mixed and were then dispersed by using a pressure dispersion type homogenizer to prepare a coloring agent dispersion solution.

2000 g of ion-exchange water, 280 g of styrene, 50 g of n-butyl acrylate, 20 g of methacrylic acid and 3 g of t-dodecyl mercaptan were added to the coloring agent dispersion solution and stirred, and at the same time, the temperature of a dispersion solution was raised to 80° C. A polymerization initiator solution constituting 8 g of potassium persulfate dissolved in 600 g of ion-exchange water was added to the dispersion solution, and polymerization was carried out for seven hours and cooled to a room temperature so that a coloring agent composite polymer particle dispersion solution was obtained.

The coloring agent composite polymer particle dispersion solution was stirred, and at the same time, a potassium chloride solution was added. The mixed solution was associated at 90° C. for six hours and was then cooled down to the room temperature. This was filtered and was then washed with distilled water, and was dried, and 1% by weight of a hydrophobic silica particulate was then added and mixed as a fluidizing agent so that a polymerized toner particle having a mean particle size of 6.5 μm was obtained. The toner particle is set to be a toner 3.

Referring to the toner 3, a toner water adsorption ratio (T) was measured. As a result, the toner water adsorption ratio (T) of the toner 3 was 5.40.

Toner Manufacturing Example 4

100 g of a polyester resin, 10 g of carbon black and 4 g of a polypropylene wax having a low molecular weight were kneaded by a kneading machine, and were rolled and then cooled, and were roughly ground and finely ground, and were classified by means of a classifier so that powder having a mean particle size of 8.0 μm was obtained. 3 g of hydrophobic silica particulate were mixed into 100 g of powder by means of a HENSCHEL MIXER so that a ground toner was obtained. The toner particle is set to be a toner 4.

Referring to the toner 4, a toner water adsorption ratio (T) was measured. As a result, the toner water adsorption ratio (T) of the toner 4 was 1.14.

Toner Manufacturing Example 5

600 g of water and 1200 g of C.I. pigment red were stirred well by means of a flasher. 1200 g of an epoxy polyol resin was added to the mixture and was kneaded at 150° C. for 30 minutes, and 1000 g of xylene was then added and further kneaded for one hour, and the water and the xylene were then removed, and rolling, cooling and grinding were thereafter carried out so that powder was obtained. Subsequently, 100 g of an epoxy polyol resin, 8 g of the obtained powder and 2 g of a zinc salicylate derivative were mixed by means of a mixer, and were then melt-kneaded by means of a mill, and the kneaded product was rolled and cooled. Subsequently, grinding and classification were carried out so that a toner particle having a mean particle size of 8.0 μm was obtained. Furthermore, 0.5 g of a hydrophobic titanium oxide particulate and 0.5 g of a hydrophobic silica particulate were added to 100 g of the toner particle and were then mixed by means of a mixer so that a toner was obtained. The toner is set to be a toner 5.

Referring to the toner 5, a toner water adsorption ratio (T) was measured. As a result, the toner water adsorption ratio (T) of the toner 5 was 2.92.

Toner Manufacturing Example 6

83 g of a polyester resin, 8 g of a carnauba wax, 7 g of C.I. pigment red and 2 g of a silica particulate were kneaded by a kneading machine and were cooled, and were then ground finely by means of a jet mill so that powder having a mean particle size of 8.0 μm was obtained by a classifier. 0.2 g of a hydrophobic silica particulate and 0.2 g of a hydrophobic titanium oxide particulate were mixed into 100 g of powder by means of a HENSCHEL MIXER so that a toner was obtained. The toner particle is set to be a toner 6.

Referring to the toner 6, a toner water adsorption ratio (T) was measured. As a result, the toner water adsorption ratio (T) of the toner 6 was 4.59.

Example 1

As described above, the carrier 1 and the toner 1 were separately held under the HH and LL environments respectively, and were then mixed to have a toner concentration of 8% by weight to measure a charging amount under the HH environment and that under the LL environment. Based on the charging amounts, an environmental dependency index (HH/LL) was calculated by the following equation.

Environmental dependency index (*HH*/*LL*)=(charging amount under *HH* environment)/(charging amount under *LL* environment)

The carrier 1 and the toner 1 were mixed to have a toner concentration of 8% by weight so that a developer A was manufactured.

An actual copying test was carried out under each environmental condition by using a developer A in accordance with the conditions described above and an image density (LL condition), a fog (HH condition) and carrier sticking (HH condition) were thus measured. The result is set forth in Table 1.

Examples 2 to 6 and Comparative Examples 1 to 3

Developers B to I were manufactured, and an actual copying test was carried out and an evaluation was made in the same manner as those in the example 1 except that the combination of a carrier particle and a toner particle and a toner concentration were changed as shown in Table 1. The result of the evaluation is set forth in Table 1.

TABLE 1

| | Developer | Carrier | Toner | T/D (%) | T | C | T/C | HH q/m (μC/g) | LL q/m (μC/g) | HH/LL | Carrier sticking | Initial image quality: Image density LL | Initial image quality: Fog HH | Image quality after 50,000 sheets: Image density LL | Image quality after 50,000 sheets: Fog HH | General Evaluation |
|---|---|---|---|---|---|---|---|---|---|---|---|---|---|---|---|---|
| Ex. 1 | A | Carrier1 | Toner1 | 8 | 2.84 | 6.90 | 0.41 | 36.0 | 44.0 | 0.82 | ○ | 1.27 | 0.87 | 1.20 | 1.12 | ○ |
| Ex. 2 | B | Carrier2 | Toner2 | 8 | 2.17 | 15.07 | 0.14 | 33.9 | 40.1 | 0.85 | Δ | 1.30 | 0.77 | 1.23 | 1.01 | Δ |
| Ex. 3 | C | Carrier3 | Toner3 | 5 | 5.40 | 7.17 | 0.75 | 31.4 | 36.7 | 0.86 | ○ | 1.35 | 0.73 | 1.28 | 0.89 | ○ |
| Ex. 4 | D | Carrier5 | Toner4 | 8 | 1.14 | 0.82 | 1.39 | 22.5 | 27.7 | 0.81 | ◎ | 1.36 | 0.75 | 1.33 | 0.82 | ◎ |
| Ex. 5 | E | Carrier4 | Toner1 | 4 | 2.84 | 1.59 | 1.79 | 24.6 | 30.5 | 0.81 | ◎ | 1.33 | 0.90 | 1.34 | 0.85 | ◎ |
| Ex. 6 | F | Carrier8 | Toner4 | 5 | 1.14 | 1.05 | 1.09 | 26.1 | 29.1 | 0.90 | ◎ | 1.38 | 0.70 | 1.37 | 0.68 | ◎ |
| Comp. Ex. 1 | G | Carrier7 | Toner6 | 8 | 4.59 | 29.23 | 0.16 | 26.6 | 31.1 | 0.86 | X | 1.05 | 0.65 | 0.88 | 0.88 | X |
| Comp. Ex. 2 | H | Carrier6 | Toner5 | 5 | 2.92 | 0.38 | 7.68 | 20.2 | 32.0 | 0.63 | ◎ | 1.15 | 1.75 | 1.13 | 1.65 | X |
| Comp. Ex. 3 | I | Carrier5 | Toner3 | 8 | 5.40 | 0.82 | 6.59 | 19.7 | 38.4 | 0.51 | ◎ | 1.14 | 1.85 | 1.01 | 1.97 | X |

What is claimed is:

1. A dry two-component developer for electrophotography comprising a carrier particle and a toner particle, wherein a toner water adsorption ratio (T) obtained by a following equation (1) for the toner particle ranges from 01.0 to 7.0 and a carrier water adsorption ratio (C) obtained by a following equation (2) for the carrier particle is 20.0 or less, and a water adsorption ratio (T/C) expressed in a following equation (3) representing a relationship between the toner water adsorption ratio (T) and the carrier water adsorption ratio (C) is 5.0 or less;

a toner water adsorption ratio ($T$)=a water adsorption amount ($T_H$) of the toner particle/an $N_2$ adsorption amount ($T_N$) of the toner particle (1), a carrier water adsorption ratio ($C$)=a water adsorption amount ($C_H$) of the carrier particle/an $N_2$ adsorption amount ($C_N$) of the carrier particle (2), and a water adsorption ratio ($T/C$)=a toner water adsorption ratio ($T$)/a carrier water adsorption ratio ($C$) (3).

2. The dry two-component developer for electrophotography according to claim 1, wherein the water adsorption ratio (T/C) ranges within 1.0±0.9.

3. The dry two-component developer for electrophotography according to claim 1, wherein the carrier particle has a mean particle size of 20 to 100 μm.

4. The dry two-component developer for electrophotography according to claim 1, wherein a core material of the carrier particle is a ferrite particle expressed in a following formula (A);

$(MO)_m(Fe_2O_3)_{n\ (A)}$ (wherein the formula (A), m+n=100 mol %, M represents at least one metal atom selected from the group consisting of Li, Ca, Cu, Mn, Zn, Mg, Ti, Sr and Sn, and MO represents an oxide of the metal atom or in combination of two or more kinds.

5. The dry two-component developer for electrophotography according to claim 1, wherein a carrier surface is coated with a silicone type resin.

6. The dry two-component developer for electrophotography according to claim 1, wherein a resin coated layer contains a silane coupling agent.

7. The dry two-component developer for electrophotography according to claim 1, wherein a resin coated layer contains a conductive particulate.

* * * * *

UNITED STATES PATENT AND TRADEMARK OFFICE

CERTIFICATE OF CORRECTION

PATENT NO. : 6,905,806 B2
DATED : June 14, 2005
INVENTOR(S) : Naito et al.

It is certified that error appears in the above-identified patent and that said Letters Patent is hereby corrected as shown below:

Column 21,
Line 27, “01.0 to 7.0” should read -- 1.0 to 7.0 --.

Signed and Sealed this

Fourth Day of October, 2005

JON W. DUDAS
*Director of the United States Patent and Trademark Office*